United States Patent [19]

Rathi

[11] Patent Number: 4,621,742

[45] Date of Patent: Nov. 11, 1986

[54] BOOM EXTENSION STORAGE MEANS AND MECHANISMS

[75] Inventor: Ram N. Rathi, Cedar Rapids, Iowa

[73] Assignee: Harnischfeger Corporation, Milwaukee, Wis.

[21] Appl. No.: 694,944

[22] Filed: Jan. 25, 1985

[51] Int. Cl.[4] ..... B66C 23/70

[52] U.S. Cl. ..... 212/177; 212/187; 212/266; 292/143

[58] Field of Search ..... 212/176, 177, 186, 187, 212/266, 188; 292/40, 143

[56] References Cited

U.S. PATENT DOCUMENTS

| | | | |
|---|---|---|---|
| 1,749,769 | 3/1930 | Johnson | 292/143 |
| 2,611,580 | 9/1952 | Troche et al. | 212/186 |
| 2,867,333 | 1/1959 | De Shano | 212/177 |
| 2,986,829 | 6/1961 | Myers | 292/143 |
| 3,196,979 | 7/1965 | Garnett | 212/187 |
| 3,785,505 | 1/1974 | Keller | 212/177 |
| 4,431,109 | 2/1984 | Behrendt et al. | 212/187 |
| 4,483,447 | 11/1984 | Bernabe | 212/177 |

*Primary Examiner*—Trygve M. Blix
*Assistant Examiner*—Thomas J. Brahan
*Attorney, Agent, or Firm*—James E. Nilles

[57] ABSTRACT

A mobile crane comprises a multi-section telescopic main boom and a boom extension pivotally connected to the point end of the main boom. The boom extension can be manually swung horizontally between an in-use position extending axially from the point end of the main boom and a stored position parallel to and alongside the main boom. Front and rear boom extension storage mechanisms releasably secure the boom extension in stored position. The front mechanism comprises two vertically spaced-apart storage pins which are slidable in tubular pin guides mounted on one lateral side of the main boom. The storage pins are slidably movable fore and aft by a swingable lever to which they are pivotally connected. The storage pins move into and out of engagement with a pair of vertically spaced-apart aligned pin-engaging holes in a member attached to a confronting side of the boom extension when the latter is in stored position. The lever is not only pivotable but is axially shiftable into and out of latched position and is biased into latched position to prevent unlatching due to "bounce". The rear storage mechanism comprises a ramp on the side of the main boom which engages and supports a roller on a member attached to a confronting side of the boom extension and a removable pin secures the member to the ramp.

7 Claims, 10 Drawing Figures

BOOM EXTENSION STORAGE MEANS AND MECHANISMS

BACKGROUND OF THE INVENTION

1. Field of Use

This invention relates generally to cranes, particularly mobile cranes, having a multi-section telescopic main boom and an optionally usable boom extension which is pivotally connected to the point end of the main boom and is swingable manually between an in-use position where it is axially aligned with and attached to the main boom and a stored position wherein it is reversed and lies alongside and is secured to the main boom.

In particular, the invention relates to an improved boom extension storage means and mechanisms for releasably securing the boom extension in stored position.

2. Description of the Prior Art

U.S. Pat. Nos. 4,318,488, 4,141,455 and 3,968,884 are each assigned to the assignee of the present application and each discloses a mobile crane having a multi-section telescopic main boom, an optionally usable storable boom extension and boom extension storage means for releasably securing the boom extension in stored position alongside the base section of the main boom. In U.S. Pat. No. 4,141,455, when the boom extension is in its in-use position, the point end of the main boom is rigidly connected to the base or foot end of the boom extension by means of retractable/extendable attachment pins on the boom extension which are releasably engageable with holes provided in clevises on the point end of the fly section of the main boom. When the main boom and boom extension are disposed in horizontal position, as is the case during attachment or detachment of the boom extension, the attachment pins are vertically disposed on opposite lateral sides of the boom extension. If, in these circumstances, the attachment pins on one lateral side of the boom extension are retracted by means of a manually operable rotatable crank and those on the other lateral side remain extended, then the boom extension can be swung or pivoted manually in a horizontal plane about the extended attachment pins between the in-use position and a position wherein it is reversed and lies alongside the main boom. Boom extension storage means are provided in U.S. Pat. No. 4,141,455 to releasably secure the boom extension in a stored position alongside the main boom. These means comprise front and rear storage mechanisms and each mechanism comprises releasably inter-engageable components mounted on a side of the base section of the main boom and on the confronting side of the boom extension when the latter is disposed alongside the main boom. In particular, these components comprise pin-receptacles welded to the side of the base section and storage pins which are welded to the side of the boom extension and extend axially rearwardly when the boom extension lies reversed and alongside the main boom. Thus, in this prior art construction, the storage means are brought into play as follows. Assume that the main boom is a full-power boom and has all telescopic boom sections fully retracted, except for the outermost fly section which is left slightly extended. Also assume that the main boom and the boom extension rigidly secured thereto has been lowered to generally horizontal position. First, the attachment pins on the appropriate side of the point end of the boom are vertically retracted manually by means of the crank. Then the boom extension is manually swung horizontally about the unretracted attachment pins to a position longside the main boom, wherein the storage pins in both the front and rear storage mechanisms are aligned but not yet engaged with their respective pin-receptacles. Finally, the fly section is fully retracted so that the storage pins enter and engage their respective pin-recepticles and so that the boom extension is thereby stored and secured. Setting up the boom extension requires carrying out the above steps in reverse order. As is apparent, in the prior art U.S. Pat. No. 4,141,455, storing and/or setting up the boom extension for use generally requires two people or several trips by one person back to the operator's cab of the crane from whence main boom extension and retraction is controlled. This is time-consuming and costly. The storage mechanism in the other aforementioned patents pose comparable problems and employ storage mechanisms which are relatively complex and costly.

SUMMARY OF THE PRESENT INVENTION

The present invention provides improved boom extension storage means and mechanisms for releasably securing an optionally usable boom extension alongside the main boom of a crane. The storage mechanism is advantageously employed on a mobile crane and can be used with a main boom having a single section or having telescopic multiple sections.

The invention is employed in a crane in which the main boom and any extension thereon can be raised and lowered in a vertical plane and which is accessible to the crane operator for manipulation when it is lowered to a generally horizontal position.

Furthermore, the boom extension is pivotally connected to the point end of the boom and can be manually swung horizontally between an in-use position wherein it is rigidly secured by suitable means and extends axially from the point end of the main boom and a stored position wherein it lies reversed and parallel to and alongside the main boom. If preferred, the base end of the boom extension can be completely detached from the point end of the main boom while in stored position.

The boom extension storage means comprise front and rear storage mechanisms which releasably secure the boom extension in stored position. The front or main storage mechanism comprise pin means slidably mounted for axial movement in pin guide means preferably mounted on one side of the main boom base section. The pin means are axially movable by a manually movable lever to which they are pivotally connected into and out of engagement with pin-engaging means preferably attached on a confronting side of the boom extension and aligned with the pin means when the boom extension is in stored position. The lever is generally vertically disposed and the upper end thereof is pivotally and slidably connected to the main boom base section and is swingable fore and aft to cause the pin means to engage and disengage, respectively, the pin-engaging means. The lever is pivotable in a vertical plane and can also be shifted vertically up or down in the vertical plane for a short distance to unlatched and latched positions, and is biased downwardly into either of two latched positions to prevent the lever from "bouncing" out of a latched position by biasing means. The lever is releasably latchable in its fore and aft positions by a projection thereon which engages either a front or rear notch in a pair of horizontally spaced apart notches provided in fixed position on the boom base section. Shifting the lever upwardly against the bias so that its projection disengages both notches permits it to be swung fore and aft.

In a preferred embodiment the pin means comprises two pins which are vertically spaced apart from each other and each pin is pivotally connected to the lever in such a manner that vertical movement of the lever does not effect movement of the pins and that the pins do not prevent vertical movement of the lever.

Furthermore, the pins are slidably mounted in tubular pin guides which are mounted on bracket means attached to the side of the boom base section, and the lever is pivotally mounted on this same bracket means. The pin engaging means comprises a vertically disposed plate having a pair of vertically spaced apart holes therein and attached to the side of the boom extension.

The rear storage mechanism comprises a ramp attached to the side of the boom base section for supportably receiving a roller which is attached by a horizontally extending member to the side of the boom extension and a pin for releaseably securing the member to the ramp.

The boom extension storage means and mechanisms in accordance with the present invention offer several advantages over the prior art. For example, the unique and simple storage mechanisms allow storing/erecting operation of the boom extension by one man, instead of two or more as in prior art cranes, and without wasted motion. Both pins in the front storage mechanism are operated with one lever motion. The lever is locked or latched in engaged or disengaged position to prevent "bounce" and unlocking. Adjustable mounting bracket means in the front and rear mechanisms can be adjusted to facilitate alignment and to accomodate wear on components occuring in the field. The roller mounted on the horizontally extending member in the rear storage mechanism allows easy climb onto and off of the ramp when the boom extension is swung into or out of stored position. The boom extension storage means in accordance with the invention are economical to fabricate and install and are easy to use and reliable in use. Other objects and advantages of the invention will hereafter appear.

DRAWINGS

DESCRIPTION OF A PREFERRED EMBODIMENT

Figure 1:
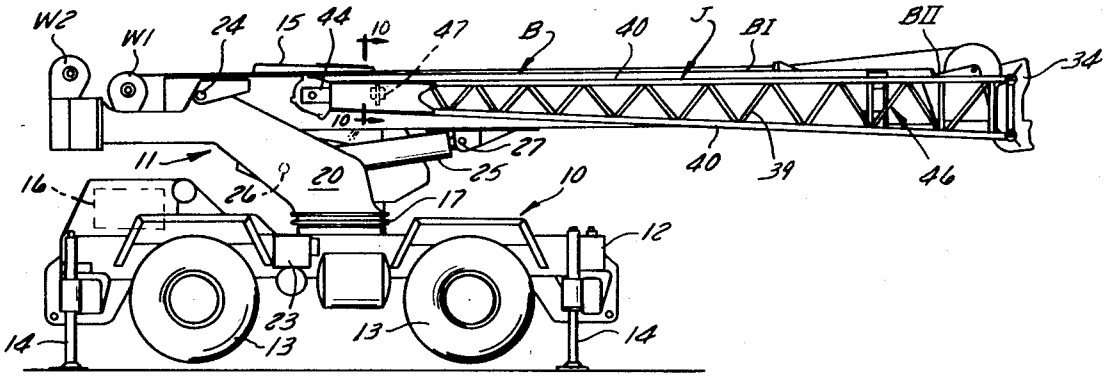
FIG. 1 is a side elevational view of a mobile crane comprising a telescopic main boom, an optionally usable boom extension pivotally connected to and shown in stored position alongside the main boom, and storage means, for releasably securing the boom extension in stored position.
Figure 2:
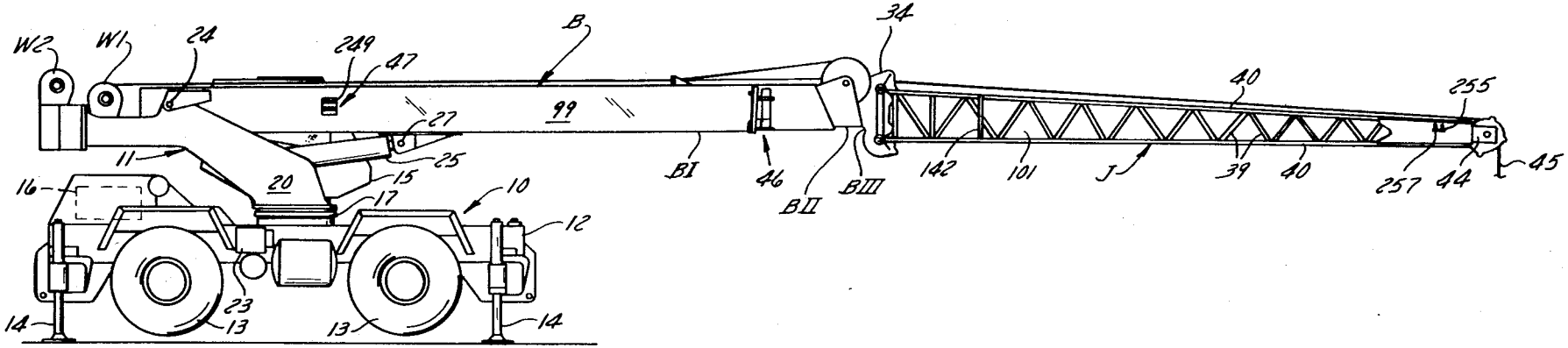
FIG. 2 is a view similar to FIG. 1 but showing the boom extension connected to the point end of the main boom in its in-use position and showing both the front and rear storage mechanisms of the storage means.

Referring to FIGS. 1 and 2, there is shown apparatus such as a mobile crane in accordance with the invention and which comprises a lower unit 10 in the form of a vehicle and an upper unit 11 which is mounted for horizontal rotation in either direction on the lower unit by means of a conventional turret 17. Vehicle 10 comprises a chassis 12 on which are mounted ground wheels 13, extendable outriggers 14, a driver's and crane operator's cab 15 and an internal combustion engine 16 behind the cab for driving the ground wheels. Upper unit 11 comprises a supporting framework 20 on which are mounted a telescopic boom B, and main and auxiliary winches W2 and W1, respectively, on which load hoist lines are wrapped. The internal combustion engine 16 also drives a hydraulic pump 23 located in the lower unit 10 which supplies operating fluid for the winches Wl and W2 and for hydraulic cylinders located in the upper unit and hereinafter described.

Boom B, which is shown in a generally horizontal telescoped and stored position lengthwise of vehicle 10, comprises three hollow boom sections, namely: a base section BI, a midsection BII, and a fly section BIII. Boom base section BI is pivotally connected to framework 20 of upper unit 11 by pin means 24. Extendable and retractable hydraulic boom hoist cylinders 25 are provided to raise and lower boom B and each is pivotally connected to and between framework 20 and boom base section BI by pin means 26 and 27, respectively. Fly section BIII is provided with a working head 34 at the boom point on which a sheave 35 (FIGS. 3, 4, 5) for a load hoist line is rotatably mounted.

Extendable and retractable hydraulic boom extension cylinders (not shown) are located within boom B and are connected to boom sections BII and BIII, respectively, to effect axial extension and retraction of the latter. Control means (not shown) are understood to be provided to operate the cylinders either individually or in unison, depending upon the crane operator's choice.

Figure 3:
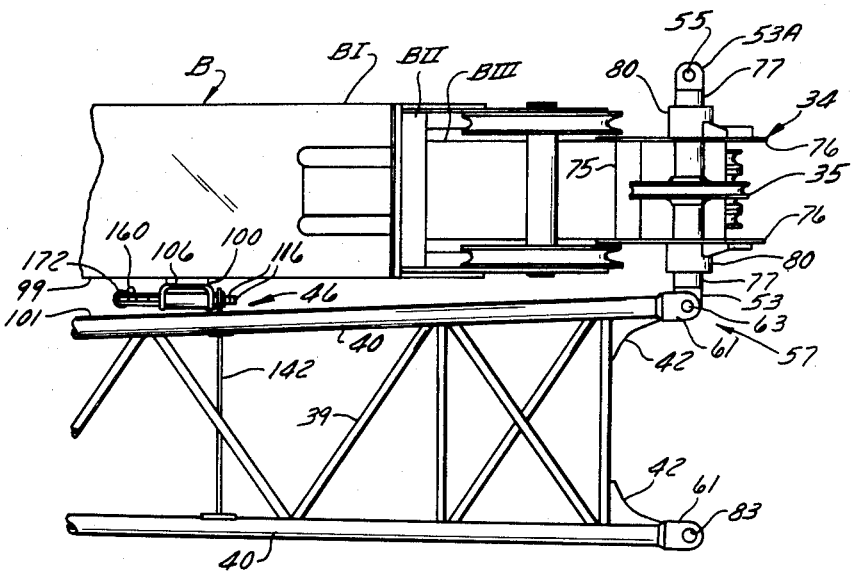
FIG. 3 is an enlarged top plan view of portions of the point end of the main boom and of the base end of the boom extension, both shown in the same position as in FIG. 1, and showing the front storage mechanism in engaged condition.
Figure 5:
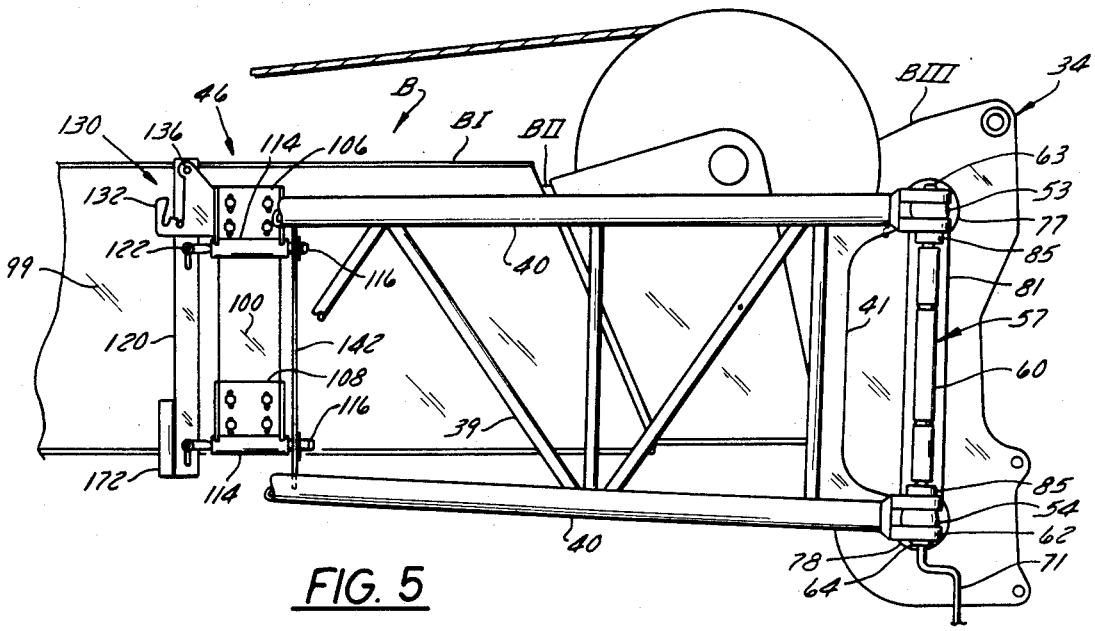
FIG. 5 is an enlarged side elevational view of the front storage mechanism showing it in engaged condition.

As FIGS. 1 and 2 show, the mobile crane has an optionally useable lattice-type boom extension J storable alongside boom B, with the base end of the boom extension adjacent the point end of the boom. Boom extension J is a hollow lattice-type section comprising four longitudinal members 40 interconnected by cross-braces 39 and by gussets 41 and 42 at its base end. Boom extension J is provided with a working head 44 at the point on which a sheave (not shown) for the load hoist line 45 is rotatably mounted. When boom extension J is stored, as shown in FIGS. 1, 3 and 5, it is reversely disposed with respect to boom B, i.e., its foot or base end is adjacent, near or toward the point of boom B and its point end is adjacent, near or toward the base of foot end of boom B. Boom extension J is stored alongside the lateral side 99 of base section BI of crane boom B by means of a pair of longitudinally spaced apart front and rear storage support assemblies or mechanisms 46 and 47, respectively, each of which has components mounted on boom base section BI and on boom extension J.

As FIGS. 1, 2–5 show, manually operable self-storing releasable pinning means are provided for releasably connecting the boom extension J to the boom head 34 whereby the boom extension can be swung around from storage position substantially parallel to the boom B to an in-use position in alignment with the boom and for locking the boom extension in the in-use position. The pinning means comprises a pair of vertically aligned and spaced apart pin-receiving members 53, 54 and 53A, 54A on each lateral side of the boom head 34 and each pin-receiving member has a pin-receiving hole 55 therein. The pinning means also comprises a pair of pin assemblies 57 (only one visible) mounted on opposite lateral sides of the base end of the boom extension J for releasably connecting the boom extension to the boom head 34. In operation, the one pin assembly 57 is operated to connect the boom extension J to one pair of pin-receiving members 53, 54 on one side of the boom head 34 while the boom extension is in storage position to enable the boom extension to be swung between the storage and in-use positions, whereupon the other pin assembly 57 is operated to secure the boom extension to the other pair of pin-receiving members 53A, 54A on the other side of the boom head.

Each pin assembly 57 comprises a vertically disposed rotatable tubular housing 60 which is rotatably mounted between a pair of upper and lower clevises 61 and 62 on a side of the boom extension base end. The housing 60 is provided with an upper foot pin 63 and lower foot pin 64 at its upper and lower ends, respectively, which foot pins are extendable and retractable with respect to the housing as the housing is rotated as by means of a crank 71. Reference may be had to aforementioned U.S. Pat. No. 4,141,455 for a complete description of the pin assemblies 57 and their mode of operation.

Boom Head and Pin-Receiving Members

Figure 4:
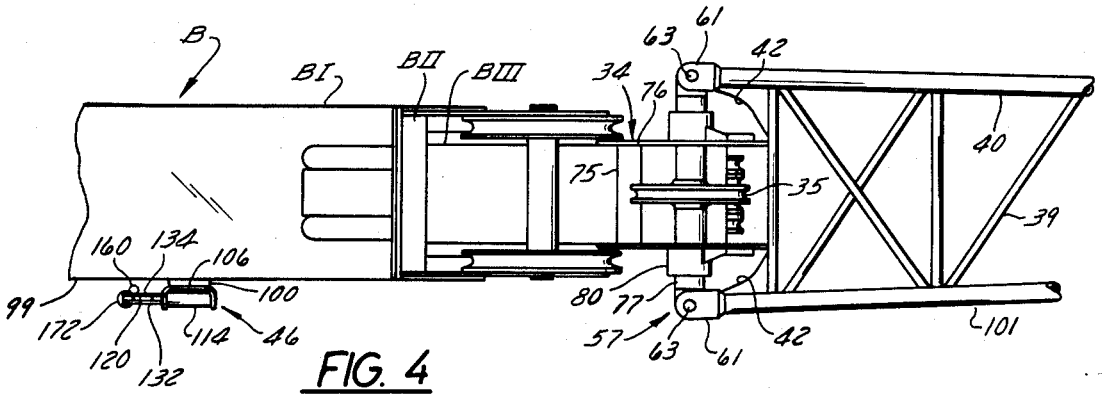
FIG. 4 is a top plan view similar to FIG. 3 but showing the main boom and boom extension in the same position as in FIG. 2, and showing the front storage mechanism in disengaged condition.

As FIGS. 3, 4 and 5 show, the boom head 34 of boom B comprises a cross plate 75 which is rigidly secured as by welding to the outermost forward end of the boom fly section BIII and two laterally spaced apart side plates 76 which are rigidly secured as by welding on opposite sides of the cross plate 75. The side plates 76 support upper and lower cylindrical rods or pins 77 and 78, respectively, which extend through the side plates 76 and are rigidly secured thereto as by welding. The ends of the rods 77 and 78 extend outwardly for a short distance beyond the side plates 76 and are shaped so as to provide the pin-receiving members 53A, 53 and 54A, 54. Each pin-receiving member is flattened at that portion whereat the pin-receiving hole 55 extends therethrough so as to enable the pin-receiving member to be receivable within its associated clevis 61 and 62 on the base end of the boom extension J. The pin-receiving members 53 and 54 comprise a first pair of vertically spaced apart pin-receiving members on one side of head 34 and the pin-receiving members 53A and 54A comprise a second pair on the other side of the head. The holes 55 in each pair are vertically aligned or in registry with each other. As FIG. 3 shows, head 34 is further strengthened by collars 80 which are welded on the outer sides of the plates 76 and through which the pins 77 and 78 extend. A base 81 is disposed between each pair of upper and lower collars 80 and is welded thereto and to its associated side plate 76.

Boom Extension Base End and Pin Assemblies

As FIGS. 3 and 5 best show, boom extension J is of lattice-type construction and comprises four tubular longitudinal members 40 which are interconnected by tubular welded-in-place cross members 39. At its base end, boom extension J is further reinforced and rigidified by the pair of vertically extending gussets 41, each of which is welded between an upper and lower longitudinal member 40, and by four horizontally disposed gussets 42, each of which is welded between a longitudinal member 40 and the last horizontal cross brace 39 of the boom extension J. At its base end, boom extension J is provided with four clevises such as the two upper clevises 61 and the two lower clevises 62. Each clevis is welded to the end of a longitudinal member 40 and to the gusset plates 41 and 42. Each leg of a gusset 61, 62 is provided with a hole 83 for accommodating passage of the associated foot pin 63, 64. Preferably, each leg of a clevis 61, 62 is chamferred as at 84 to facilitate engagement of the clevis with an associated pin-receiving member.

As FIG. 5 shows, the underside of each upper clevis 61 and the upper side of each lower clevis 62 is provided with a collar 85 which has a pin-receiving opening (not visible) therethrough. Each collar is secured to its associated clevis as by welding around the periphery thereof. Each collar 85 is provided with a threaded opening for receiving a threaded set screw which has a lock nut thereon to prevent relative rotation of the foot pin during operation of the pin assembly as hereinafter explained. When tubular housing 60 is rotated in one direction by means of crank 71, the pins 63 and 64 move in opposite directions with respect to each other, i.e., both move inward of tube 60 together or move outward of tube 60 together relative to their passage through the holes 55 in the pin-receiving members 53, 53A, 54, 54A during operation. The upper foot pin 63 takes the form of a solid member whereas the lower foot pin 64 is hollow and provided with the central bore (not shown) for accommodating the passage of the crank 71 therethrough.

Boom Extension Storage Mechanisms

FIG. 2 shows the boom extension storage means which includes the front boom extension storage mechanism 46 and the rear boom extension storage mechanism 47 which support the boom extension J on boom B when the boom extension is not in use. The boom extension storage assemblies 46 and 47 employ components, hereinafter described, which are mounted on one of the outer lateral sides of the boom base section BI and the adjacent lateral side of the reversely disposed boom extension J. As FIGS. 3 and 4 show, the boom extension J is stored in such a manner that, when boom fly section BIII is properly adjusted, the holes 83 on the innermost upper and lower clevises 61 and 62 of the boom extension will be in registry with the holes 55 in the upper and lower pin-receiving members 53 and 54, respectively, on the boom head 34 to facilitate connection of the boom extension base end to the boom head 34 by means of the pinning assembly 57.

When the boom extension J is swung from stored position at the side of boom B it can be swung about the pinning assembly 57 into alignment with boom B and then secured thereto by means of the other pinning assembly 57 (not visible).

As FIGS. 6–9 show, front boom extension storage mechanism 46 comprise components mounted on lateral side 99 of base section BI of main boom B and cooperating components mounted on the boom extension J and extending from lateral side 101 thereof.

The components mounted on base section BI include a base plate 100 which is welded to side 99 of base section BI near the point end thereof and which is provided with a plurality of tapped holes 102 (eight provided but only four visible in FIG. 6) for receiving a plurality of threaded cap screws 104 which secure a pair of upper and lower support brackets 106 and 108, respectively, to base plate 100. Each support bracket 106, 108 is of generally U-shaped cross-sectional shape and has two outwardly laterally projecting forward and rear legs 110 and 112, respectively. Each support bracket 106, 108 has a plurality of vertically elongated cap screw-receiving holes 111 (eight shown in FIG. 7) which, when loosened, enable vertical adjustment of the support brackets and a plurality of stacked shim plates 112 are located between each support bracket 106, 108 and base plate 100 to enable horizontal adjustment of the support brackets (see FIG. 6).

Each support bracket 106, 108 has a horizontal pin guide tube 114 welded to the lower end of the legs 110 and 112 thereof for receiving and guiding a cylindrical storage pin 116 which is slidably mounted therein and movable by means of a lever 120 to which it is pivotally attached.

Figure 6:
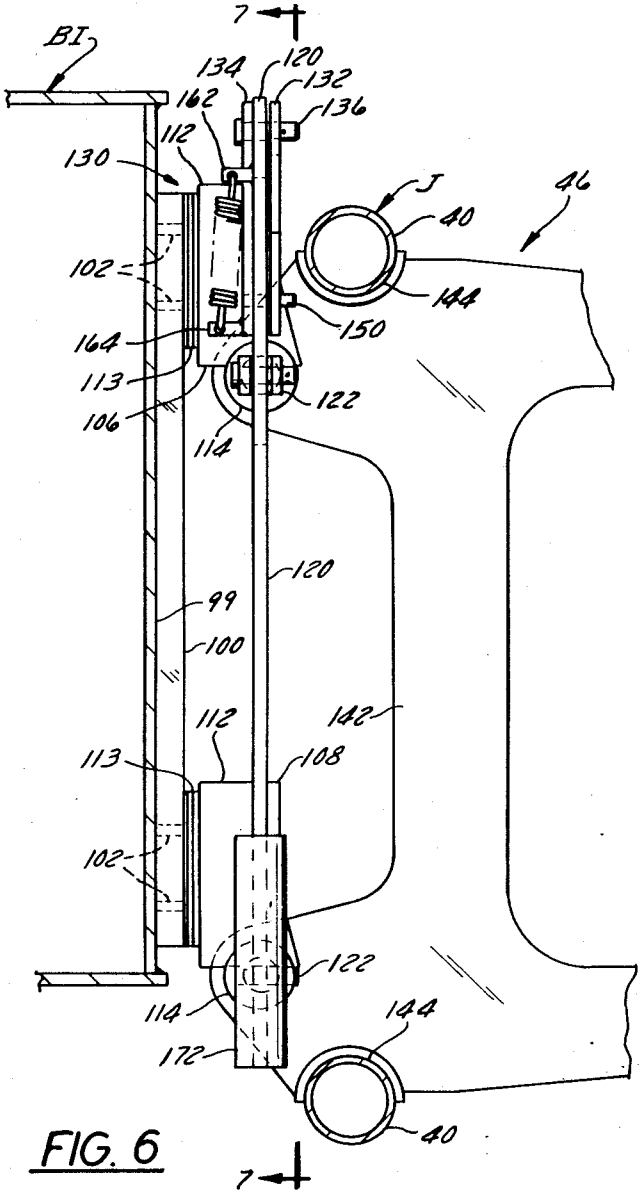
FIG. 6 is greatly enlarged elevational view of the rear side of the front storage mechanism.
Figure 9:
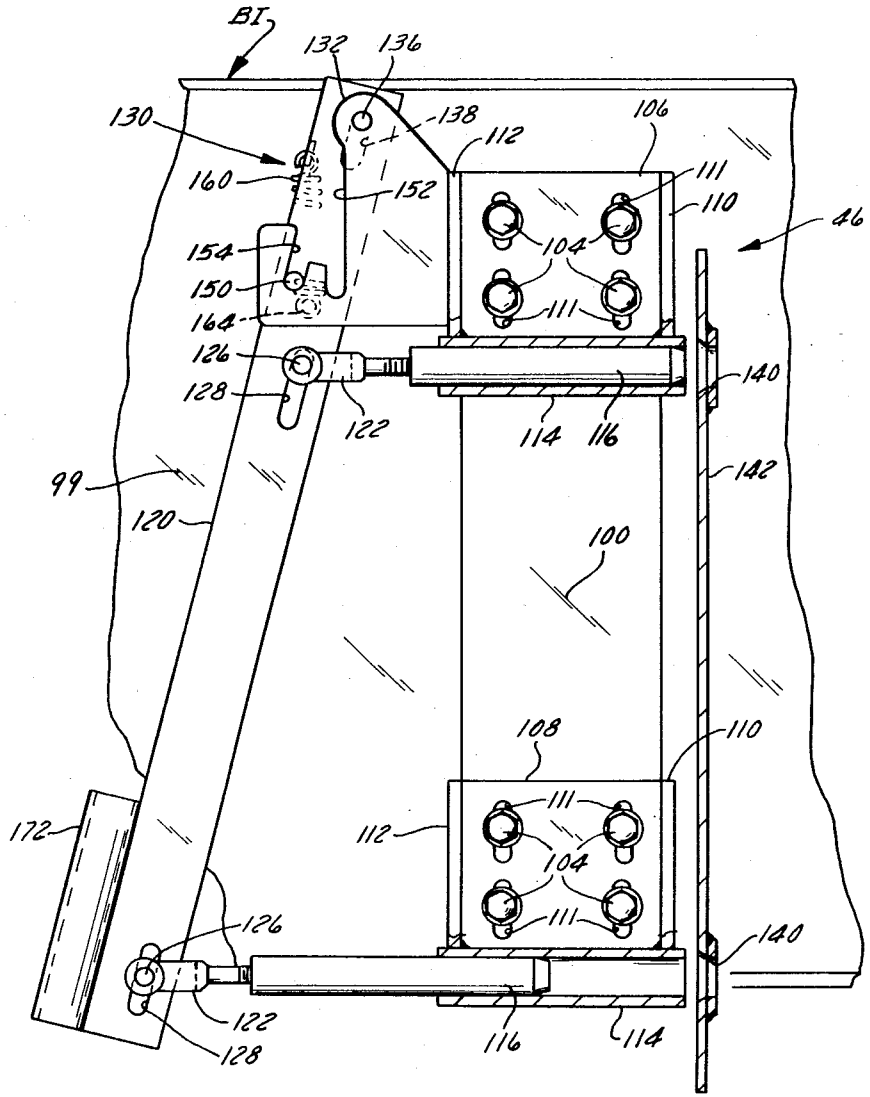
FIG. 9 is a side elevational view similar to FIGS. 7 and 8 but showing the front storage mechanism latched in fully disengaged condition.

Lever 120 is pivotally and shiftably connected at its upper end to a lever support assembly 130 which, in turn, is rigidly secured to rear leg 112 of upper support bracket 106. In particular, as FIG. 6 shows, assembly 130 comprises a stationary outer plate 132 and a stationary inner plate 134 which is spaced from plate 132 and these plates rigidly support lever pivot pin 136 which is engaged in an elongated hole 138 in the upper end of lever 120. This arrangement enables lever 120 to be swung manually in a vertical plane (parallel to side 99 of base boom section BI) between a pin-engaged position (FIG. 7) and pin-disengaged position (FIG. 9).

Figure 7:
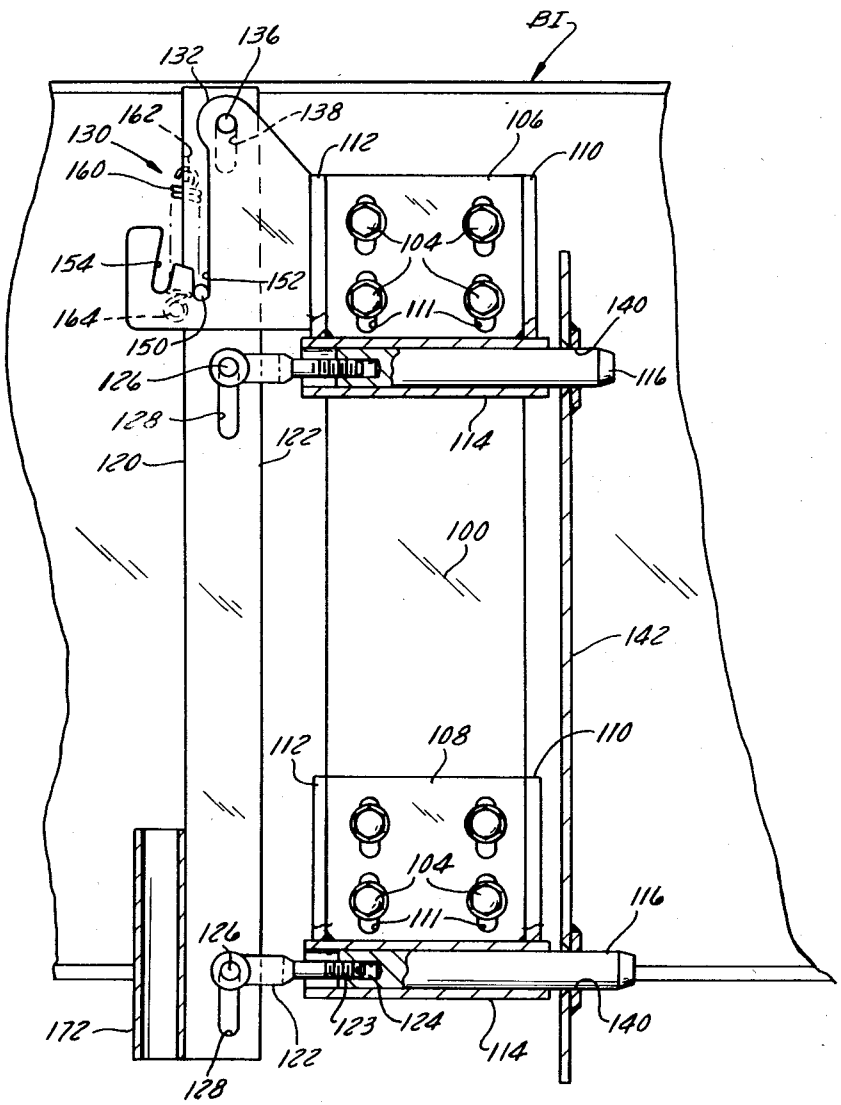
FIG. 7 is a side elevational view taken on line 7—7 of FIG. 6 and showing the front storage mechanism in fully engaged and latched condition.

As FIG. 7 shows, each of the two pins 116 is attached to lever 120 by means of a pivot pin assembly 122 which has one threaded end 123 which screws into a threaded bore 124 in pin 116. Each of the two pivot pin assemblies 122 has a pivot pin 126 at its other end which engages one of two vertically spaced-apart elongated holes 128 provided in lever 120.

Lever 120 is swingable as above-described to cause the storage pins to correspondly move between engaged position (FIG. 7) and disengaged position (FIG. 9) wherein the outer end retract from two vertically spaced apart pin-engaging holes 140 formed in a means such as a component or plate member 142 rigidly mounted in boom extension J.

As FIGS. 2, 3, 5, 6 and 7 show, plate member 142 is disposed transversely to the longitudinal axis of boom extension J and is rigidly secured thereto as by welding at the locations 144 to the four longitudinal members 40 of boom extension J. That portion of plate member 142 which projects laterally outwardly of the side 101 of boom extension J is provided with the two pin-engaging holes 140. When the boom extension J is swung alongside main boom B, the holes 140 are in axial registry with the storage pins 116. The hereinbefore described adjustment screws 104 and adjustable shims 113 can be positioned as necessary to effect proper registration during final assembly of the crane and after crane usage during which wear may cause mis-alignment.

Figure 8:
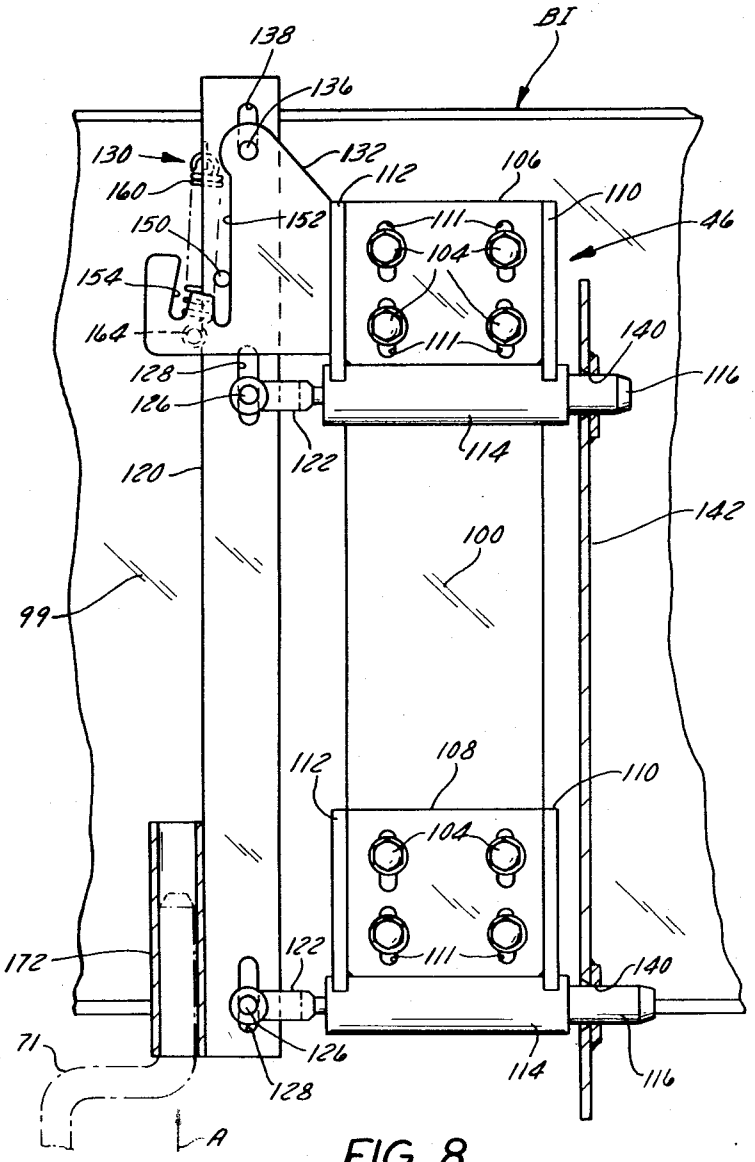
FIG. 8 is a side elevational view similar to FIG. 7 but showing the front storage mechanism in unlatched but fuilly engaged condition prior to being moved to fully disengaged condition.

Lever 120, in addition to being manually swingable pivotally fore and aft, is manually shiftable along its own longitudinal axis in a vertical plane between lever-latched positions (FIGS. 7 and 9) and a lever-unlatched position (FIG. 8). The engagement of lever pivot pin 136 in lever hole 138 permits such movement. In addition, the engagement of the pivot pin 126 of each storage pin 116 in the associated elongated hole 128 enables such shifting movement of lever 120 without disturbance of or inhibition by the storage pins 116.

Releasable latching or locking means are provided to enable lever 120 to be latched in either storage pin-engaged position (FIG. 7) or in storage pin-disengaged position (FIG. 9) or to be placed in unlatched position (FIG. 8) while in transit between the two latched positions. The latching means comprise a latch pin 150 which is rigidly secured to and extends from the outer side of lever 120 near the upper end thereof. Latch pin 150 is releasably engageable with either of two horizontally spaced apart latching slots 152 (forward) and 154 (rearward) provided in outer plate 134 of lever support assembly 130, hereinbefore described. FIGS. 7 and 9 show lever 120 latched in storage pin-engaged and storage pin-disengaged positions, respectively, wherein latch pin 150 engages slot 152 or 154, respectively.

Means are provided to releasably bias or maintain lever 120 in either of its latched positions to thereby prevent bouncing of the crane boom B or the entire vehicle 10 from causing lever unlatching. Such means comprise a helical compression spring 160 which has its upper end anchored to an upper spring attachment pin 162 rigidly secured on the inner side of lever 120 near the upper end thereof and which has its lower end anchored to a lower spring attachment pin 164 rigidly secured on inner plate 134 of rigid lever support assembly 130. Spring 160 operates to bias or pull lever 120 axially downwardly (with respect to the drawing figures) into a latched position but allows the lever to be shifted upwardly in the direction of arrow A in FIG. 8 to unlatched position wherein latch pin 150 is clear of the slots 152 and 154.

As previously mentioned, lever 120 is manually pivotable and shiftable and these movements are facilitated by use of an elongated tool, such as crank 71 which engages an attachment tube 172 (FIGS. 8 and 9) which is welded to the lower end of lever 120. The tool 71 could take various forms but is preferably the same hereinbefore mentioned crank 71 which is used to pin and unpin the boom extension J from the point end of main boom B when the crane is being set-up or taken down (see FIG. 5).

Figure 10:
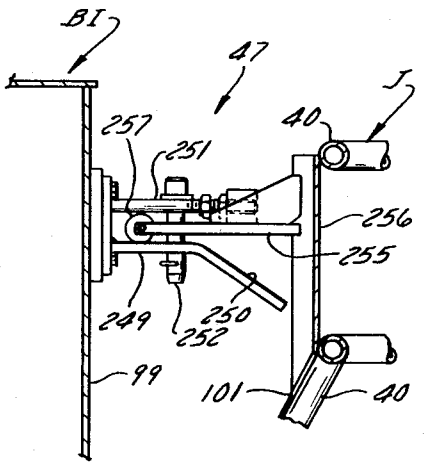
FIG. 10 is a view taken on line 10—10 of FIG. 1 and showing the rear storage mechanism in detail.

The boom extension rear storage mechanism 47, shown in FIGS. 2 and 10, operates to slightly raise the sagging point end of the boom extension J as it is swung into stored position and also releasably locks it against horizontal sway. Mechanism 47 comprises a bracket 249 welded to the side of boom base section BI from which a ramp 250 and an adjustable stop 251 on boom extension extend laterally. The ramp 250 and stop 251 are provided with aligned holes (not visible) to receive a manually insertable and removable vertically disposed securement pin 252. Rear storage assembly 47 also comprises a bracket 255 welded to a side gusset plate 256 at the point end of boom extension J and which carries a roller 257. Bracket 255 is provided with a pin hole (not visible) for receiving securement pin 252. When boom extension J is swung into stored position, as hereinafter explained in detail, roller 257 climbs on ramp 250 and adjustable stop 251 limits inward swing of the boom extension J so that all three pin holes (not visible) are aligned and can accept manual insertion of pin 252 which prevents lateral swinging motion of the boom extension J while the latter is in stored position.

OPERATION

The boom extension storage means in accordance with the present invention are employed with boom B and boom extension J as follows. Initially, assume that the apparatus is in the condition shown in FIGS. 1, 3, 5 and 8 wherein the boom extension J is reversely disposed with respect to boom B, is in stored position. To disengage the boom extension J from stored position and to swing it into its in-use position, it is first necessary that the pinning assembly 57 engage one side of the base end of the boom extension J and one side of the boom head 34 to enable outward swinging of boom extension J from stored position.

Now assume that, as FIG. 7 shows, the storage pins 116 are engaged in the holes 140 in plate 142 of boom extension J and that lever 120 is in latched position. The machine operator standing on the ground then uses tool 71 to engage tube 172 on lever 120 to raise or shift the lever to unlatched position (FIG. 8) and then swings the raised lever rearward to storage pin-disengaged position and lets it descend slightly to latched position (FIG. 1) with the storage pins retracted.

Boom extension J is now swung from stored position (FIG. 1) to the in-use position (FIG. 2) and the tool 71 is removed from tube 172 and used to operate the other pinning assembly 57 to secure the boom extension in the in-use position. In order to operate the other pinning assembly 57 to effect extension of the foot pins thereof and rigidly secure the boom extension J in its in-use position, it is necessary to release the locking means 73 so that the housing 60 of pinning assembly 57 can be rotated. When this is done, the crank 71 is inserted through the foot pin 64 into engagement with the hole in the crank plate. When this is done, manual rotation of crank 71 causes rotation of housing 60 and, since the foot pins 63 and 64 are prevented from rotation by means of their associated set screws, the foot pins are caused to extend from the housing 60 as the housing rotates. The foot pins move through the holes 83 in the upper and lower clevises 61 and 62 and through the holes 55 in the pin-receiving elements 53 and 54. The boom B with the boom extension J attached as described above, is ready for operation as soon as the necessary rigging is accomplished.

Boom extension J is stored by reversing the above-described procedures. While the boom extension J is in the in-use position, the main boom B is fully retracted and left in approximately horizontal position. The operator can then shut the machine off. The foot pins of the said other pinning assembly 57 are retracted and the boom extension J is manually swung horizontally alongside the boom B. From the ground, the lever 120 is lifted out of the rear slot 154 by means of tool 71 and rotated to engage both top and bottom pins 116 with the receptable holes 140 on the boom extension. The lever 120 is left in the forward slot 152 in the engaged position and is locked in position by the hold down spring 160 (see FIG. 7). Because boom extension J is long and heavy, the point end thereof tends to sag slightly into a position wherein it would not be in proper alignment. The ramp 250 of the rear mechanism 47 gradually eases the point of the boom extension J upwardly as the boom extension is swung inwardly and is engaged by the roller 257. The pin 252 is then employed.

It is to be understood that the foregoing description pertains to a telescopic boom which is a "fullpower" boom in which all retractable/extendable boom sections are individually controlled and movable. In the case of a telescopic boom having a "manual" fly section wherein the fly section is not independently controllable, the fly section is moved by the boom section in which it telescopes by means of pins. In such a case, the manual fly section is "pinned" for retraction and cannot be left slightly extended and the boom section in which it telescopes is, instead, left slightly retracted.

I claim:

1. In a crane:

a main boom;

a boom extension;

means for pivotally connecting said boom extension to said main boom so that said boom extension can be swung between an inuse position in axial alignment with said main boom and a stored position alognside said main boom;

and storage means for releasably securing said boom extension in said stored position, said stroage means including:

pin means mounted on one of said main boom and said boom extension;

pin-engaging means mounted on the other of said main boom and said boom extension;

a lever mounted on one of said main boom and said boom extension and pivotally movable between a pin-disengaged position and a pin-engaged position and operable to effect corresponding relative movement between said pin means and said pin-engaging means, said lever being shiftably movable as well as pivotally movable;

and latch means for releasably securing said lever in either of its positions, said latch means comprising releasably inter-engageable means on said lever and on that boom on which said lever is mounted which engage or disengage in response to shifting movement of said lever, said latch means further including biasing means connected between said lever and that boom on which said lever is mounted for biasing said lever so that said releasable inter-engageable means are engaged.

2. A crane according to claim 1 wherein said pin means is mounted on said main boom and said pin-engaging means is mounted on said boom extension.

3. A crane according to claim 1 or 2 wherein said pin means comprises at least one pin which is pivotably and slidably connected to said lever.

4. In a crane:

a main boom;

a boom extension;

means for pivotally connecting said boom extension to said main boom so that said boom extension can be swung bewteen an inuse position in axial alignment with said main boom and a stored position alongside said main boom;

and storage means for releasably securing said boom extension in said stored position, said storage means including a storage mechanism comprising:

pin-engaging means mounted on said boom extension;

a lever pivotably and shiftably mounted on said main boom;

at least one pin pivotably and shiftably connected to said lever;

said lever being pivotally movable between a pin-disengaged position and a pin-engaged position and operable to effect corresponding relative movement between said pin and said pin-engaging means;

and latch means for releasably securing said lever in either of its said positions, said latch means comprising releasably inter-engageable means on said lever and on said main boom which engage or disengage in response to shifting movement of said lever, said latch means further comprising biasing means connected between said lever and said main boom for biasing said inter-engageable means in engagement.

5. A crane according to claim 4 wherein said storage means further comprises another storage mechanism spaced from said first storage mechanism lengthwise of said main boom and comprising:

ramp means extending laterally from said main boom;

a roller support means extending laterally from said boom extension;

a roller rotatably mounted on said support means and engageable with said ramp means when said boom extension is in said stored position;

and means for releasably securing said main boom to said boom extension when the latter is in stored position.

6. A crane according to claim 5 wherein said last-recited means comprises a member releasably engageable with said ramp means and said roller support means.

7. A crane according to claim 5 or 6 wherein said other storage mechanism further comprises an adjustable stop member for locating said roller support means in a predetermined position relative to said ramp means to enable engagement of said member.

* * * * *